US007464991B2

(12) United States Patent
Tinsley-Kim

(10) Patent No.: US 7,464,991 B2
(45) Date of Patent: Dec. 16, 2008

(54) INFLATABLE TWO-CHAMBERED RECTANGULAR OTTOMAN WITH ATTACHED SHOULDER STRAP AND POCKET

(75) Inventor: Karen Michelle Tinsley-Kim, Oviedo, FL (US)

(73) Assignee: Karen M. Tinsley-Kim, Oviedo, FL (US)

( * ) Notice: Subject to any disclaimer, the term of this patent is extended or adjusted under 35 U.S.C. 154(b) by 0 days.

(21) Appl. No.: 11/651,475

(22) Filed: Jan. 10, 2007

(65) Prior Publication Data

US 2008/0164728 A1 Jul. 10, 2008

(51) Int. Cl.

| | |
|---|---|
| ***A47C 16/02*** | (2006.01) |
| ***A47C 7/50*** | (2006.01) |
| ***A47C 4/00*** | (2006.01) |
| ***A47C 9/00*** | (2006.01) |

(52) U.S. Cl. ..... 297/461; 297/462; 297/423.1; 297/423.39; 297/423.41; 297/423.44; 297/423.45; 297/183.1; 297/452.41

(58) Field of Classification Search ..... 297/462, 297/461, 423.1, 423.4, 423.41, 423.44, 452.45, 297/183.1, 452.41, 423.45, 423.39
See application file for complete search history.

(56) References Cited

U.S. PATENT DOCUMENTS

| | | | | | |
|---|---|---|---|---|---|
| 2,982,341 | A * | 5/1961 | Besser | 297/461 X |
| 3,029,109 | A * | 4/1962 | Nail | 297/462 X |
| 3,110,532 | A * | 11/1963 | Nail | 297/462 X |
| 3,744,845 | A * | 7/1973 | Sooker | 297/423.44 |
| 3,803,645 | A * | 4/1974 | Oliverius | 297/423.4 X |
| 4,067,607 | A * | 1/1978 | Battles | 267/462 X |
| 4,218,093 | A * | 8/1980 | Gertz | 297/461 X |
| 4,232,477 | A * | 11/1980 | Lin | 297/462 X |
| 4,673,216 | A * | 6/1987 | Alfer | 297/423.1 X |
| 4,708,393 | A * | 11/1987 | Fallis et al. | 297/452.41 |
| 4,836,605 | A * | 6/1989 | Greenwood et al. | 297/452.41 X |
| 4,842,330 | A * | 6/1989 | Jay | 297/452.41 X |
| 5,005,902 | A * | 4/1991 | Farnworth et al. | 297/452.41 X |
| 5,029,350 | A * | 7/1991 | Edelson | 5/652 |
| 5,302,003 | A * | 4/1994 | Xenofos | 297/423.44 |
| 5,303,977 | A * | 4/1994 | Sereboff | 297/452.41 X |
| 5,374,109 | A * | 12/1994 | Wortman | 297/423.41 X |
| 5,806,110 | A * | 9/1998 | Kunz et al. | 297/452.41 X |
| 5,836,653 | A * | 11/1998 | Albecker | 297/452.31 |
| 6,012,778 | A * | 1/2000 | Peterson | 297/452.41 |
| 6,089,668 | A * | 7/2000 | Peterson | 297/452.41 |
| 6,135,551 | A * | 10/2000 | Linder | 297/452.41 X |
| 6,209,962 | B1 * | 4/2001 | Sobel et al. | 297/452.41 X |
| 6,406,098 | B1 * | 6/2002 | Linder | 297/452.41 |
| 6,478,380 | B2 * | 11/2002 | Ehrlich | 297/423.41 X |
| 7,008,020 | B2 * | 3/2006 | Becker et al. | 297/452.41 |

* cited by examiner

*Primary Examiner*—Rodney B. White

(57) ABSTRACT

An inflatable two-chambered rectangular ottoman with attached shoulder strap and pocket is an inflatable bladder constructed from polyvinyl-chloride material with heat sealing for assembly. The two chambers allow for flexibility in firmness of support and height either as a footrest with one chamber inflated or as an ottoman with varying levels of support dependent upon which side the ottoman rests on the floor. Additional support is provided in the ottoman by additional ribbing on each side also made from polyvinyl-chloride material. The ottoman has a velour surface on five sides. The sixth side is two-layered non-velour polyvinyl-chloride material with an opening on one of the shorter sides to form a pocket. Attached to the inner layer of the non-velour PVC side are the two ends of the attached adjustable carrying strap. The strap can be placed inside the pocket when in use on the floor.

4 Claims, 2 Drawing Sheets

INFLATABLE TWO-CHAMBERED RECTANGULAR OTTOMAN WITH ATTACHED SHOULDER STRAP AND POCKET

BACKGROUND OF THE INVENTION

This invention is a lightweight ottoman that can be easily transported and that provides a variety of levels of support.

BRIEF DESCRIPTION OF THE VIEW OF THE DRAWINGS

DETAILED DESCRIPTION OF THE INVENTION

Figure 1A:
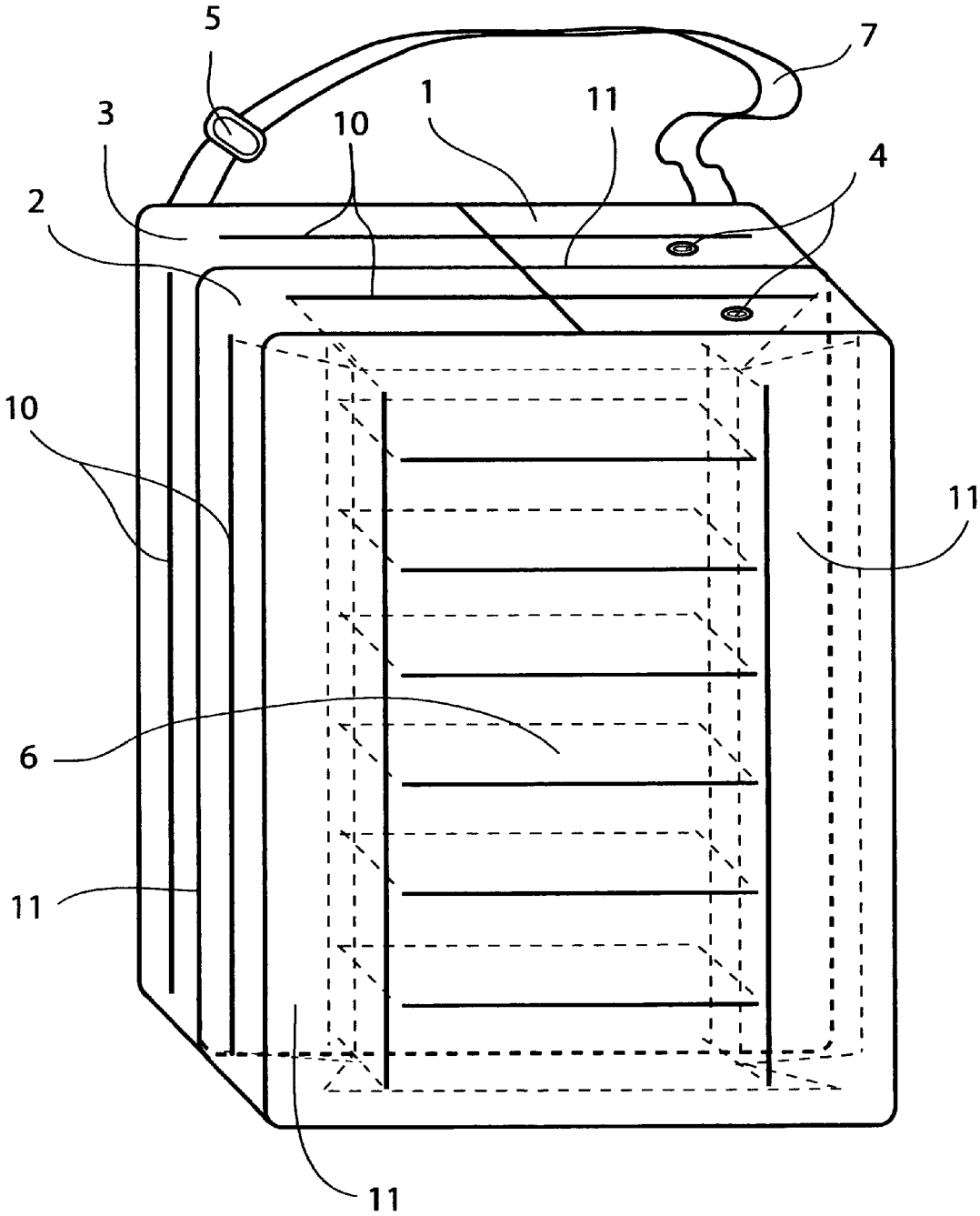
FIG. 1A is an angled front perspective of the ottoman.
Figure 1B:
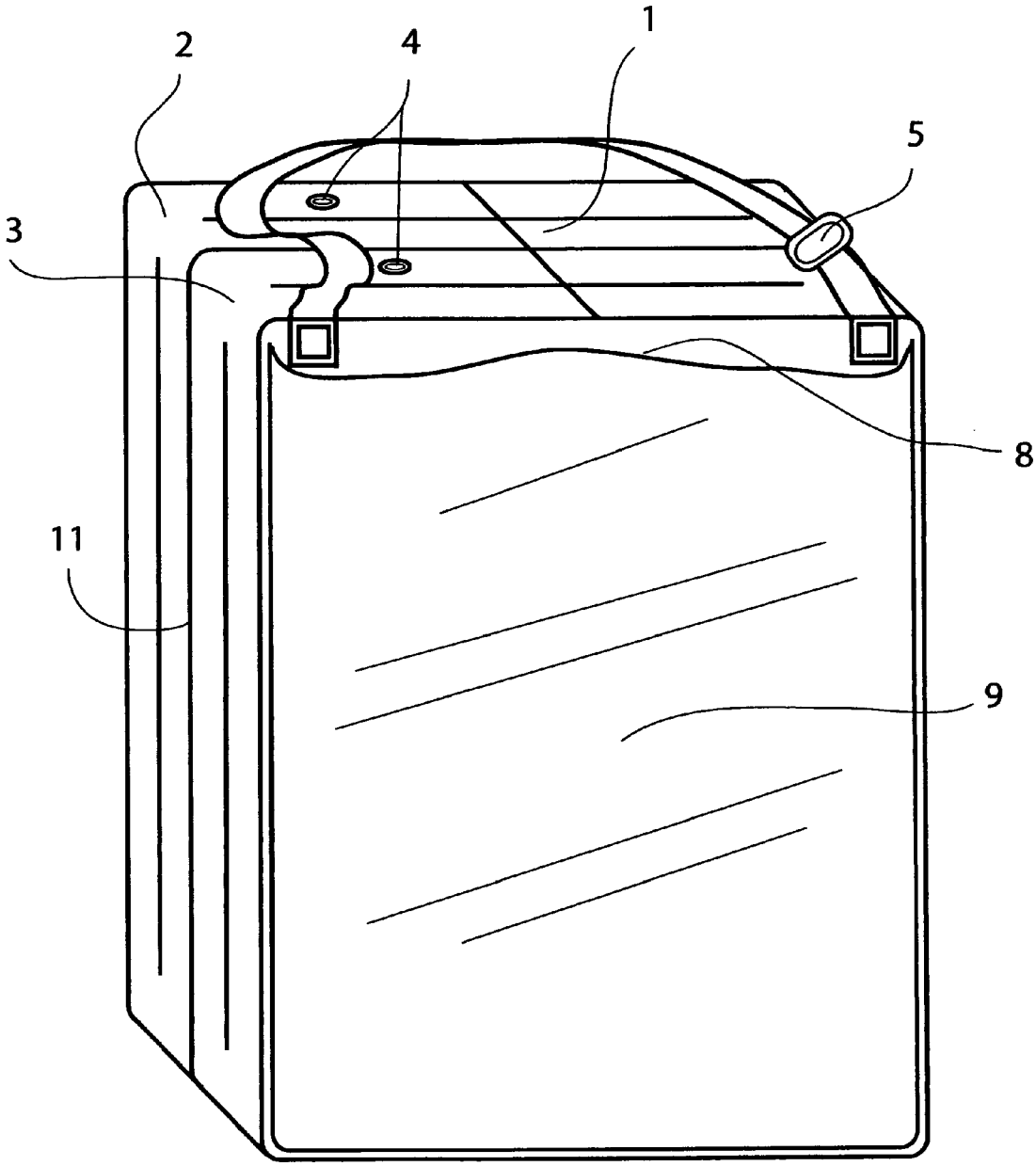
FIG. 1B is an angled back perspective of the ottoman.

Essentially the invention is an ottoman 1 formed by an inflatable bladder which is constructed from polyvinyl-chloride (PVC) material with heat sealing for assembly. The invention is distinguishable in its construction with a separate first chamber 2 and second chamber 3 attached together on the two longest and widest sides (referred to as the flat side) of each chamber to form a rectangular box shape with a velour surface on five sides of the first and second chamber combination. Attached to the sixth side of the rectangular box shape combination of chambers is a pocket side wall 9 composed of a two-layered non-velour PVC material with an unattached opening on one of the shorter sides of the chamber combination to form a pocket 8. Attached to the inner layer of the pocket side wall 9 are the two ends of an attached adjustable carrying strap 7. The carrying strap 7 can be easily placed inside the pocket 8 when in use on the floor. The carrying strap 7 includes a carrying strap adjuster 5 to adjust the length of the carrying strap. On the side of the ottoman 1 where the carrying strap 7 is attached to the pocket side wall 9, are two valves 4, one on each of the chambers.

The combination of the two chambers allows for maximum flexibility in firmness of support and height either as a footrest with one chamber inflated or as an ottoman with varying levels of support dependent upon which side the ottoman 1 rests on the floor.

Additional support is provided in the ottoman 1 by chamber side ribs 10 on the side of each of the chambers. The chamber side ribs 10 are also made from PVC material. On the shorter sides of the ottoman, there is one connecting support rib 11 which connects the chambers together.

Each chamber includes a total of eight flat side ribs 6 per flat side for support, with two of the flat side ribs 6 extending along the longest length of the chamber flat side and six flat side ribs 6 extending perpendicularly within the other two flat side ribs 6. The flat side ribs 6 of each chamber are interconnected within the respective chambers such that the flat side ribs 6 extend through the interior of each of the chambers respectively and independently of the other chamber. The flat side ribs provide additional structural support.

The invention claimed is:

1. An inflatable two-chambered rectangular ottoman to serve as either a footrest with one chamber inflated or as a multi-leveled ottoman when both chambers are inflated, with the level dependent upon amount of inflation and choice of side the ottoman rests on the ground, the inflatable two-chambered rectangular ottoman comprising:

a first and a second rectangular chamber attached together to form a combined rectangular box shape;

a pocket formed along one of the shortest sides of the combination of chambers;

an adjustable carrying shoulder strap attached within said pocket with heat sealing;

twenty four chamber flat side ribs of polyvinyl-chloride material fused internally for additional support and stability and to reduce rolling when placed on any one of its sides.

2. The inflatable two-chambered rectangular ottoman of claim 1, wherein the ottoman includes a velour surface on five sides.

3. The inflatable two-chambered rectangular ottoman of claim 1, wherein a connecting support rib connects the first and second chambers together.

4. The inflatable two-chambered rectangular ottoman of claim 1, wherein each chamber includes a valve.

* * * * *